United States Patent [19]

van den Berg

[11] 4,427,396

[45] Jan. 24, 1984

[54] METHOD OF MANUFACTURING A DEEP DRAWN CDT MASK

[75] Inventor: Adrianus H. M. van den Berg, Eindhoven, Netherlands

[73] Assignee: U.S. Philips Corporation, New York, N.Y.

[21] Appl. No.: 339,930

[22] Filed: Jan. 18, 1982

[30] Foreign Application Priority Data

Feb. 16, 1981 [NL] Netherlands ..... 8100730

[51] Int. Cl.[3] ..... H01J 9/233

[52] U.S. Cl. ..... 445/47; 148/134; 148/155

[58] Field of Search ..... 445/47, 49; 148/134, 148/155

[56] References Cited

U.S. PATENT DOCUMENTS

| | | | |
|---|---|---|---|
| 907,193 | 12/1908 | Steele | 148/155 X |
| 3,898,108 | 8/1975 | Iwasaki et al. | 148/155 X |
| 4,210,843 | 7/1980 | Avadani | 445/47 X |

*Primary Examiner*—Kenneth J. Ramsey

*Attorney, Agent, or Firm*—Joseph P. Abate

[57] ABSTRACT

Method of manufacturing a deep drawn CRT mask in which the mask blanks are cut from the steel foil, each mask blank having a pattern of apertures. To facilitate the subsequent deep drawing and in order to obtain a grain size for good magnetic screening by the shadow mask an annealing process is carried out. An optimum grain size of the mask material between 0.015 and 0.040 mm with an average grain size between 0.020 and 0.030 mm is obtained by annealing at a temperature from 600° C. to 850° C. which lies above the temperature at which the mask blanks may adhere together by thermomolecular welding. In order to prevent rejects as a result of said welding, a stack of mask blanks is laid on a curved substrate prior to annealing (FIGS. 3*f*, 3*g*), which substrate preferably has the form of a part of a cylinder the radius of which is equal to the radius of the mask after deep drawing. After annealing in a furnace (FIG. 3*h*) the mask blanks are placed on a flat substratum (FIGS. 3*i*, 3*k*, 3*l*) in which the thermomolecular welds present are broken without damaging the mask blanks. By annealing on the curbed substrate the mask blank engages substantially the mould during deep drawing (FIG. 3*m*) so that no deformations of the mask blank occur during the deep drawing process.

4 Claims, 4 Drawing Figures

METHOD OF MANUFACTURING A DEEP DRAWN CRT MASK

Figure 1:
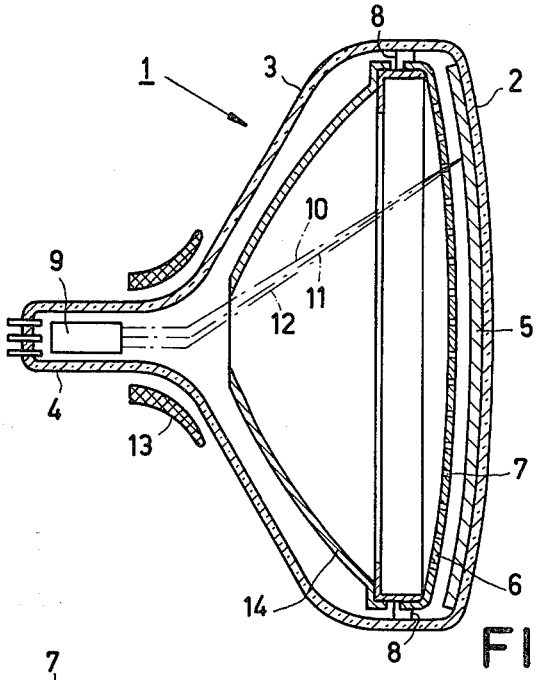
Figure 2A:
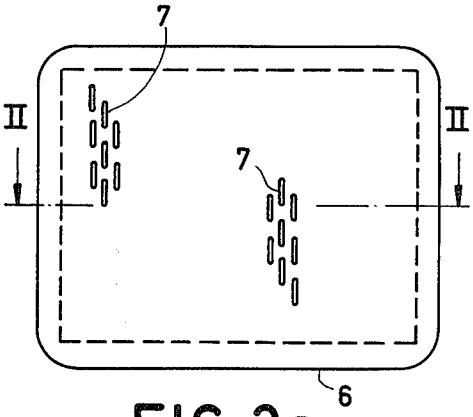
Figure 2B:
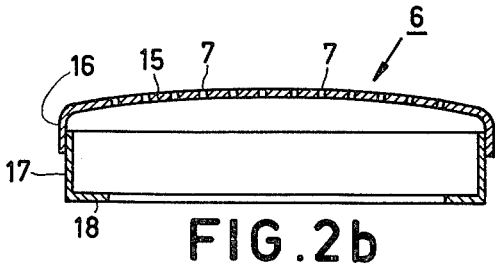

The invention relates to a method of manufacturing a colour selection electrode for a colour display tube, which colour selection electrode comprises a shadow mask blank having a pattern of apertures, the method comprising the steps of:

(a) providing patterns of apertures in a steel foil by means of a photoetching process, (b) cutting mask blanks from the steel foil, each mask blank having a pattern of apertures, (c) annealing a stack of mask blanks at a maximum temperature which is above the temperature at which the mask blanks begin to adhere together, and (d) deep drawing each mask blank in a dish form.

A colour display tube ususally comprises in a glass envelope a system of electron guns to generate three electron beams and a display screen which comprises triplets of phosphors luminescing in the colours red, green and blue. At a short distance from the display screen a colour selection electrode having a large number of apertures is suspended in such a manner that each electron beam is associated with luminescent phosphors of one colour. The colour selection electrode usually comprises a shadow mask having rows of slot-shaped apertures.

A method of a kind similar to that mentioned in the opening paragraph but using a different annealing process, is disclosed in U.S. Pat. No. 4,210,843. In this method a steel foil having a thickness of 0.15 mm to 0.20 mm is used as a starting material. The foil is manufactured from an interstice-free steel. An interstice-free steel is to be understood to mean a type of steel having a comparatively large hardness and a low carbon content, to which small quantities of one or more of the elements such as titanium, niobium, zirconium and aluminium have been added. These elements form carbides and nitrides with the carbon atoms and nitrogen atoms present in the steel. Patterns of apertures are provided in the steel foil by means of a photoetching process. The steel foil is then cut into pieces in such manner that flat mask blanks having a pattern of apertures are obtained. In order to prevent rejects as a result of mechanical damage during the preceding process steps, the starting material is comparatively hard.

However, the flat mask blanks are too hard to be deep drawn into their ultimate dish shape. In order to reduce the hardness of the mask blanks in behalf of deep drawing, the mask blanks are annealed at a comparatively low temperature for a given period of time. For this purpose the mask blanks are formed into a stack of, for example, 20 blanks and annealed in a furnace for 1 to 2 hours, the maximum annealing temperature being between 600° and 850° C. In all cases, however, the maximum annealing temperature is lower than that temperature at which the mask blanks start adhering together due to molecular thermal welding processes (sintering). By annealing the mask blanks under these conditions, a recrystallization of the steel material takes place, a grain size having a diameter of at most 0.04 mm being obtained. Due to the growth of the grain size the hardness of the mask blanks is reduced to a sufficient extent for the mask blanks to be deep drawn to their ultimate shape.

The advantage of the use of interstice-free steel in the above-described process is that this type of steel shows substantially no yield point elongation so that during deep drawing of the mask no stretcher strains occur. As a result of this, annealing can be carried out at lower temperatures than in the usual manufacturing method and the mask blanks after annealing need not be subjected to a roller leveling operation either.

A disadvantage of this known method, however, is that as a result of the annealing at a maximum temperature below the temperature at which the mask blanks start adhering together a small average grain size is obtained. As a result of this small average grain size a poor magnetic screening by the shadow mask occurs. In a colour display tube the electron beams should be screened from the earth's magnetic field so as to prevent colour defects as a result of mislanding. In a colour display tube the electron beams are screened from the earth's magnetic field by a screening cap of ferromagnetic material usually provided in the tube and the shadow mask which is also manufactured from ferromagnetic material. The small magnetic screening in shadow masks manufactured according to the known method occur in particular with large display tube formats, for example, display tubes having a screen diagonal of 56 cm or 66 cm. In the case of small display tube formts the mask ring connected to the mask blank ensures a reasonable magnetic screening. In order to obtain a better magnetic screening a larger average grain size of the mask material is required. This larger average grain size can be obtained by annealing the mask blanks at a maximum temperature which lies above the temperature at which the mask blanks start adhering together by thermomolecular welding. In this case a mask blank cannot be taken as such from a stack of mask blanks after annealing, since in that case scratches, tears and bends may occur in the mask blanks so that the mask blanks become useless. Consequently, the adhesion of the mask blanks is a problem when the mask blanks are annealed at a maximum temperature which lies above the temperature at which the mask blanks start adhering together.

In the usual manufacturing method which is described as prior art in U.S. Pat. No. 4,210,843, types of steel are used which show yield point elongation. In order to prevent that due to said yield point elongation stretcher strains occur when the mask is deep drawn, said yield point elongation should be removed as far as possible prior to deep drawing. For this purpose the mask blanks are annealed at a comparatively high temperature (900°-950° C.) and for a comparatively long period of time (3.5-5.5 hours) and the mask blanks after annealing are roller levelled. Since annealing is carried out at high temperatures, the mask blanks adhere together due to thermo-molecular welding processes. In order to reduce said adhesion of a stack of mask blanks, a number of spacers may be provided between the mask blanks, for example, five mask blanks being present between two spacers. However, the spacers themselves cause new problems. The spacers which are usually manufactured from glass may cause scratches on the mask blanks. Moreover, in the course of time the spacers become brittle so that the spacers have to be replaced frequently, which makes the use of spacers expensive. As a result of the spacers, fewer mask sheets can moreover be stacked, so that per unit of time fewer mask sheets can be annealed. This increases the cost of the annealing process. Therefore, the spacers do not solve the problem of the adhering together of the mask sheets.

It is therefore the object of the invention to provide a method of manufacturing a colour selection electrode for a colour display tube with which a solution is obtained in a simple manner for the adhesion together of the mask blanks upon annealing.

For that purpose, a method of a kind mentioned in the opening paragraph is characterized in that, prior to annealing, the mask blanks are stacked on a curved substrate and in that after annealing the stack of mask blanks is placed on a flat substratum. As a result of the annealing the stack of mask blanks substantially assumes the shape of the curved substrate. After annealing the stack of mask blanks is removed from the substrate and placed on a flat substratum. The mask blanks are pressed against the flat substratum by the weight of the stack. The mask blanks will slide on each other, the thermo-molecular welds present being broken without tears, bends and other damage of the mask blanks occurring. The mask blanks may now be taken from the stack, after which each mask blank again assumes the curved shape of the substrate. A mask blank obtains its ultimate dish shape by placing the mask blank, for example, on a spherical mould and then deep drawing the mask on the mould by means of a die.

An embodiment of the method is characterized in that the substrate has the shape of a part of a cylinder the radius of which is substantially equal to the radius of the mask blank after deep drawing. Since after annealing a mask blank already has substantially the curved shape of said substrate, the mask blank better engages the mould for the deep drawing. As a result of this creases in the corners of the mask blank upon deep drawing are prevented. It has actually been found that upon deep drawing on a convex lower mould of large mask blanks, which, after annealing are still entirely flat, uneven deformations in the corners of the mask blank may occur. Since the mask blank does not readily engage the mould, the place where the mask blank along its circumference is taken upon deep drawing is not determined reproducibly. An excess of mask material in one or more corners causes that upon deep drawing the mask blank is not readily drawn against the mould. After deep drawing this results in visible creases in the relevant corners.

A further embodiment is characterized in that the steel foil is manufactured from an interstice-free steel, that the maximum temperature during annealing is between approximately 600° C. and 850° C., and that annealing is carried out for approximately 45 minutes to 120 minutes. The annealing under these conditions of mask blanks which are manufactured from interstice-free steel provides a grain size of the mask material which is between approximately 0.015 mm and 0.040 mm. Herewith a good magnetic screening by the shadow mask is obtained.

A preferred embodiment is characterized in that the maximum temperature during annealing is approximately 760° C., the temperature being kept above approximately 750° C., for approximately 15 minutes. In this manner it has proved possible to obtain an average grain size of 0.025 mm.

Figure 3:
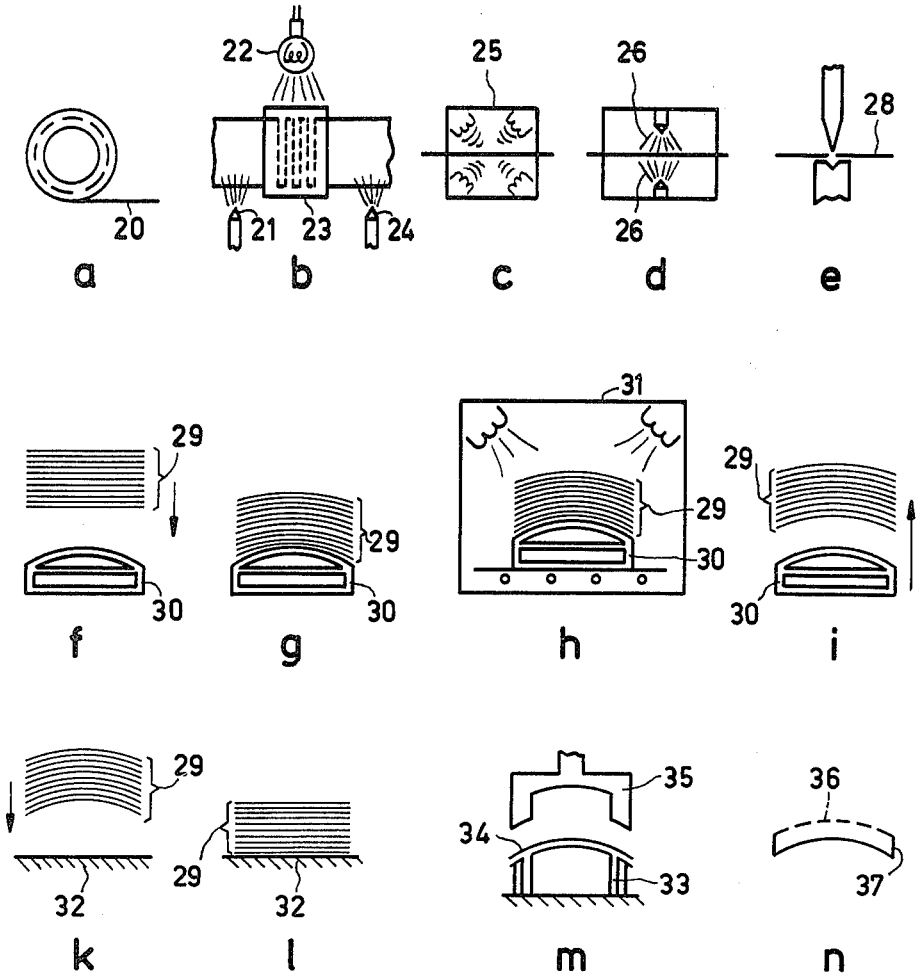

The invention will now be described in greater detail, by way of example, with reference to the accompanying drawing, in which FIG. 1 is a diagrammatic sectional view of a colour display tube having a colour selection electrode, FIG. *2a* is a plan view of the colour selection electrode from the tube shown in FIG. 1, FIG. *2b* is a sectional view taken on the line II—II of FIG. *2a*, and FIG. 3 explains the manufacture of the colour selection electrode.

The colour display tube 1 shown in FIG. 1 is formed by a glass envelope having a rectangular display window 2, a cone 3 and a neck 4. A pattern of phosphors 5 luminescing in the colours red, green and blue is provided on the display window 2. At a short distance from the display window 2 a colour selection electrode, namely a shadow mask 6, having a large number of apertures 7 is connected by means of suspension members 8 shown diagrammatically. An electron gun 9 for generating three electron beams 10, 11 and 12 is mounted in the neck 4 of the tube. Said beams are deflected by means of a system of deflection coils 13 placed around the tube and said beams intersect each other substantially at the level of the shadow mask 6 after which each of the electron beams impinges on one of the three phosphors provided on the display window 2. Furthermore connected in the tube is a conical screening cap 14 which, together with the shadow mask 6, ensures that the electron beams 10, 11 and 12 are screen from the earth's magnetic field.

FIG. *2a* is a plan view of the shadow mask 6 from the tube shown in FIG. 1. The rectangular shadow mask 6 has a large number of rows of slot-shaped apertures 7. The apertures 7, for example, have a length of 0.665 mm and a width of 0.188 mm. The distance between two apertures is, for example, 0.110 mm and the pitch between the rows of apertures is, for example, 0.775 mm. Instead of slot-shaped apertures the shadow mask may also be provided with circular, oval or differently shaped apertures. The mask blank may also be used for the manufacture of a colour selection electrode with so-called quadrupole post-focusing as is disclosed in Netherlands Patent Application No. 7904653.

FIG. *2b* is a sectional view taken on the line II—II of FIG. *2a*. The shadow mask 6 is built up from the shadow mask blank 15 provided with apertures 7 and having an upright edge 16. The shadow mask blank 15 is curved in accordance with the shape of the display window. A mask ring 17 which reinforces the shadow mask and the flange 18 of which prevents reflections of electrons at the upright edge 16 is secured to the upright edge 16.

The method of manufacturing the shadow mask will be explained in detail with reference to FIG. 3. Starting material is the steel foil 20 (FIG. *3a*) having a thickness between approximately 0.10 and 0.20 mm dependent on the desired thickness of the shadow mask. The steel foil 20 is manufactured from an interstice-free steel. This is a steel having a low carbon content, preferably between approximately 0.004 and 0.01% of carbon to which small quantities of one or more of the elements niobium, titanium, vanadium and zirconium have been added and/or one or more of the elements aluminium, silicon or phosphor have been added. These additions bind the carbon and nitrogen atoms present in the steel to carbides and nitrides. The dislocations present in the steel are not blocked by said carbides and nitrides in contrast with free carbon atoms and nitrogen atoms. As a result of this, said type of steel shows substantially no yield point elongation so that in the subsequent deep drawing of the mask blank no uneven plastic deformation occurs, which causes the formation of stretcher strains or Luder-Lines. A suitable interstice-free steel, for example, has the following composition expressed in percent, by weight:

| | | |
|---|---|---|
| C ≦ 0.01 | S ≦ 0.02 | Al~0.02–0.08 |
| Mn ≦ 0.4 | P + S ≦ 0.03 | Cr~0.01 |
| P ≦ 0.02 | Si ≦ 0.015 | Fe remainder |

Another suitable interstice-free steel is composed of

| | | | |
|---|---|---|---|
| C ≦ 0.01 | S ≦ 0.02 | Al~0.03 | Cr~0.02 |
| Mn ≦ 0.2 | P + S ≦ 0.03 | Ti~0.1 | Fe remainder |
| P ≦ 0.02 | Si ≦ 0.03 | Nb~0.01 | |

For further properties of interstice-free steel reference is made to the already mentioned U.S. Pat. No. 4,210,843.

Patterns of apertures are etched in the steel foil 20 by means of a known photoetching process. For this purpose, a photoresist layer (FIG. 3*b*) is provided on both sides of the steel foil 20 by spraying a photoresist laquer 21. The photoresist layers are then exposed to light 22 through a mask 23. After development with a developer 24 only photoresist is present in the non-exposed places. The photoresist layers are cured in an oven 25 (FIG. 3*c*). The pattern of apertures is then etched in the steel foil 20 by spraying an etchant 26 against both sides of the foil (FIG. 3*d*). After etching the apertures the photoresist layer is removed. The foil 20 is then cut to pieces so that mask blanks 28 are obtained each having a pattern of apertures (FIG. 3*e*). The steel foil 20 is comparatively hard so as to prevent damage and hence reject of mask blanks during the photoetching process. However, the mask blanks are too hard to be deep drawn to their ultimate shape. In order to make the mask blanks softer, the mask blanks are annealed. The flat mask blanks are stacked in, for example, 25 pieces without the interposition of spacers. A stack of mask blanks 29 is then laid on a curved substrate 30 which has substantially the shape of a part of a cylinder the radius of which is substantially equal to the radius of the mask blanks after deep drawing (FIGS. 3*f*, 3*g*). The mask blanks are laid on the substrate 30 in such manner that the mask blanks are curved in the longitudinal direction. The stack of mask blanks 29 on the substrate 30 is then annealed in a furnace 31 (FIG. 3*h*). In order to obtain a good magnetic screening by the shadow mask, the mask material should have a grain size between 0.015 mm and 0.040 mm with an average grain size between 0.020 and 0.030 mm. However, in order to obtain this grain size a maximum temperature during annealing is necessary which is higher than that at which the mask blanks can adhere together by thermomolecular welding. The mask blanks are passed through the oven 31 for, for example, 75 minutes in which the maximum annealing temperature is 760° C. and in which the temperature is kept above 750° C. for approximately 15 minutes. As a result of this the mask material obtains an average grain size of approximately 0.025 mm. The annealing temperature may be between approximately 600°–850° C. and the annealing time may be approximately 45 minutes–120 minutes.

After having passed through the annealing furnace 31 the stack of mask blanks 29 is taken from the substrate 30 (FIG. 3*i*). As a result of the annealing the stack of mask blanks 29 takes the shape of the curved substrate 30. The stack of mask blanks 29 is then placed on a flat substratum 32 (FIG. 3*k*). As a result of the weight of the stack 29 the mask blanks are pressed against the substratum 32 (FIG. 3*l*). The mask blanks will slide partly over each other, the thermomolecular welds present being broken without damaging the mask blanks. The mask blanks may now be taken from the stack after which each mask blank again takes the shape of the curved substrate 30.

A mask blanks is then deep drawn by placing a mask blank on a mould 33. Since the mask blank 34 in one direction already has substantially the curvature of the mould, the mask blank 34 already engages the mould 33 nearly entirely (FIG. 3*m*). As a result of this, no creasing in the corners of the mask blank occurs upon deep drawing with the die 35. In the above-described manner, mask blanks 36 having an upright edge 37 are obtained which in the tube ensure a good magnetic screening without rejects occurring during the manufacture of the masks as a result of thermo-molecular welds formed during the annealing and as a result of creasing caused by the deep drawing.

The invention is not restricted to the above-described embodiment but may be used in any method of manufacturing shadow masks in which the mask blanks are annealed at a maximum temperature which is above the temperature at which the mask blanks being to adhere together.

What is claimed is:

1. A method of manufacturing a colour selection electrode for a colour display tube, which colour selection electrode comprises a shadow mask blank which having a pattern of apertures, the method comprising the steps of:

(a) providing patterns of apertures in a steel foil by means of a photoetching process, (b) cutting mask blanks from the steel foil, each mask blank having a pattern of apertures, (c) annealing a stack of mask blanks at a maximum temperature which is above the temperature at which the mask blanks begin to adhere together, and (d) deep drawing each mask blank in a dish form, characterized in that (e) prior to annealing, the mask blanks are stacked on a curved substrate, and (f) after annealing, the stack of mask blanks is placed on a flat substratum.

2. A method as claimed in claim 1, characterized in that the substrate has the shape of a part of a cylinder the radius of which is substantially equal to the radius of the mask blank after deep drawing.

3. A method as claimed in claim 1 or 2, characterized in that the steel foil is manufactured from an interstice-free steel, that the maximum temperature during annealing is between approximately 600° C. and 850° C. and that annealing is carried out for approximately 45 minutes to 120 minutes.

4. A method as claimed in claim 3, characterized in that the maximum temperature during annealing is approximately 760° C., the temperature being kept above approximately 750° C. for approximately 15 minutes.

* * * * *